United States Patent [19]

Cunningham

[11] 4,185,859

[45] Jan. 29, 1980

[54] DOOR OPENING SYSTEM

[76] Inventor: Ralph Cunningham, 508 S. Main St., Mt. Airy, Md. 21771

[21] Appl. No.: 888,619

[22] Filed: Mar. 21, 1978

[51] Int. Cl.[2] ..... E05C 15/02

[52] U.S. Cl. ..... 292/93; 292/336.3

[58] Field of Search ..... 292/93, 126, 173, 226, 292/336.3

[56] References Cited

U.S. PATENT DOCUMENTS

| | | | |
|---|---|---|---|
| 1,738,531 | 12/1929 | Grace | 292/93 |
| 2,104,618 | 1/1938 | Hasenfuss | 292/93 |
| 2,442,733 | 6/1948 | Schultz | 292/268 |
| 2,871,050 | 1/1959 | Dickinson | 292/336.3 |
| 3,025,095 | 3/1962 | Christensen | 292/336.3 |

*Primary Examiner*—Richard E. Moore

*Attorney, Agent, or Firm*—Morton J. Rosenberg

[57] ABSTRACT

A door opening system for permitting ingress and egress through a door utilizing a displaceable impact loading in one motion of a user. The door opening system includes a broad surface planar member which extends in a transverse direction across the door to be opened. The planar member has a mechanism for actuating a door latch mounted to a rear surface thereof. By displacing the planar member in a unitary direction, the actuating mechanism which interfaces with a latch lever displaces the latch lever and removes the lever from a catch member. Thus, the door is unlatched and continued motion or displacement by the body of the user against the planar member causes an opening of the door.

11 Claims, 3 Drawing Figures

FIG. 1
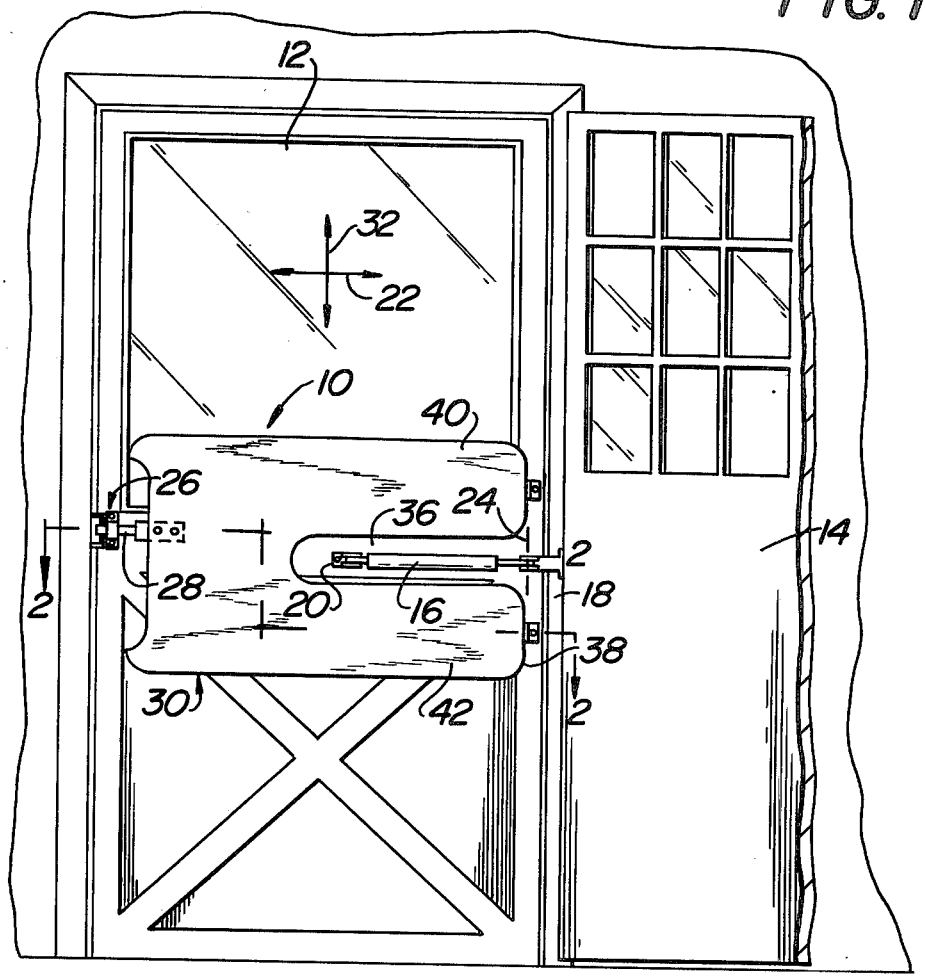
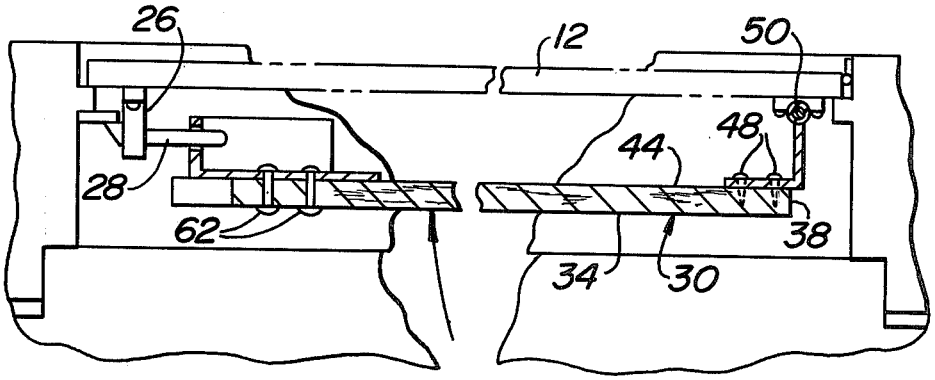
FIG. 2

DOOR OPENING SYSTEM

BACKGROUND OF THE INVENTION

1. Field of the Invention

This invention pertains to door opening systems. In particular, this invention pertains to a door opening system which allows displacement by any part of the body of a user against the system to automatically unlatch and open the door. More in particular, this invention relates to a door opening system where a broad surface planar member extends in a transverse direction across the door to be opened and displacement in a unitary direction causes automatic unlatching of the door and rotation of the door in an opening mode. Still further, this invention relates to a door opening system which is mounted on opposing transverse ends to the door to be opened and to a latch lever which is actuated by movement of the planar member. Further, this invention pertains to a door opening system which includes a planar member having a predetermined contour for clearing both automatic closing devices and interference tolerances for a door knob on an inner door.

2. Prior Art

In general, door opening systems for aiding in the opening of a door are known in the art. However, some of these prior systems provide for a bar member of complicated mechanical design having a combination of elements which is expensive to manufacture and provides increased labor costs in construction.

In some of these prior art door opening systems, the opening mechanism is provided by a bar member passing in a transverse direction across the door to be opened. Such bar mechanisms do not provide a broad surface area which may be displaced in a unitary direction by any part of the body of a user to provide the necessary opening motion.

In other prior systems, the door opening mechanism is not of a predetermined contour to permit interface of the prior door opening system with automatic closing devices which are common and generally related to storm or screen doors upon which the door opening system is to be mounted.

Still further, other prior art door opening systems do not provide cut out relief sections to allow clearance of door knobs and other door hardware relating to standard construction doors.

SUMMARY OF THE INVENTION

A door opening system for releasably actuating a door latch having a displaceable latch lever and rotatably displacing a door in one motion of a user. The door opening system includes a planar member extending in a transverse direction across the door adjacent and substantially parallel to a plane of the door. Additionally, the door opening system includes a mechanism for actuating the door latch for displacing the latch lever. The actuating means is fixedly secured to the planar member and the latch lever is positionally located in contact relation therewith.

It is an object of the subject invention to provide a door opening system which aids and maintains a convenient mode of operation in the opening of door members.

Another object of this invention is to provide an improved door opening system which is utilized specifically in doors having automatic closing devices.

It is another object of this invention to provide an improved door opening system which allows the user in one motion to release the latch holding the door in a closed mode and to further rotatably displace the door to an open position.

It is a still further object of this invention to provide a safety device for users wherein during an emergency situation, the user only has to move against the door system to provide an opening mode of operation.

Another object of this invention is to provide a broad surface door opening system which protects the glass or screens formed in the door to be opened.

BRIEF DESCRIPTION OF THE DRAWINGS

FIG. 1 is a frontal view of the door opening system showing the system mounted to an outer door;

FIG. 2 is a sectional view of the door opening system taken along the section line 2—2 of FIG. 1; and, FIG. 3 is a perspective view of the door opening system showing the particular component associated therewith.

DESCRIPTION OF THE PREFERRED EMBODIMENTS

Figure 3:
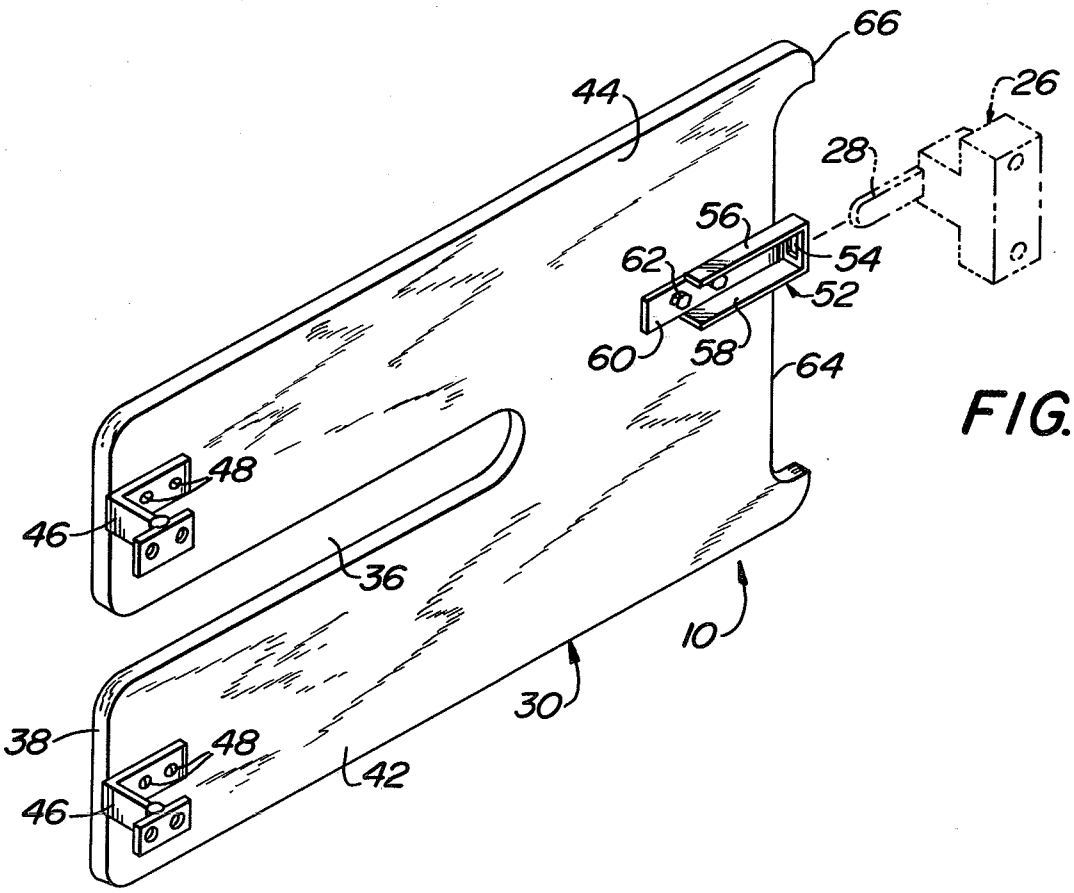

Referring now to FIGS. 1-3, there is shown door opening system 10 for aiding a user upon entry and exit through screen or storm door 12. In general, homes or other edifices have a combination of inner door 14 and an exterior screen or storm door 12 as shown in FIG. 1. A standard combination screen and storm door 12 is provided with pneumatic, hydraulic, or other type automatic closing devices 16 well known in the art, and not part of the inventive concept as is herein described. Automatic closing devices 16 generally are mounted on one end to door jam 18 and on a second end 20 to an inner surface of screen or storm door 12. As seen in FIG. 1, automatic closing device 16 extends in a transverse direction 22 and is rotationally actuatable about axis line 24 in order to permit storm door 12 to be rotated in a normal opening and closing condition. It is to be understood that door opening system 10 is applicable to existing doors 12 as may be mounted on new doors being manufactured.

Due to the fact that automatic closing devices 16 tend to provide for a closing force applied to doors 12 to which such are secured, an operator must maintain a counteracting force in order to displaceably open doors 12. As will be seen in following paragraphs, door opening system 10 provides a broad surface which allows opening of door 12 in one motion by the operator. Further, the broad surface provided by system 10 allows the operator to hold door 12 in an open position during entrance or exit while providing a minimum probability of any entanglement with hardware elements attached to door 12. Still further, system 10 allows the user to open and close doors 12 while not coming into contact with either the screens or window pane portions of doors 12. Thus, any impact loading provided by the user in the opening of doors 12 is directed against door opening system 10 and not to doors 12 per se. Door opening system 10 also provides for an emergency exit opening system whereby a user who must egress through door 12 in an expeditious manner merely displaces system 10 in one motion with a responsive opening of door 12. Utilization of door opening system 10 minimizes any necessary manipulation of latches or other locks for opening doors 12 since the displacement of system 10 by any portion of the human body results in a responsive opening of door 12.

In overall concept, door opening system 10 is utilized for releasably actuating door latch 26 which is any one of a standard number of latch mechanisms well known in the art. Door latch 26 as is the standard case, includes displaceable latch lever 28 which is contacted by the movement of system 10 for opening door latch 26 and allowing door 12 to be opened in one motion of the user. One of the basic components of door opening system 10 is planar member 30 extending in both transverse direction 22 and vertical direction 32. As can be seen in FIGS. 1 and 2, planar member 30 extends in transverse direction across door 12 in a manner such that system 10 lies adjacent and substantially parallel to a plane of door 12. Of importance, inner face 34 of planar member 30 is provided with a broad surface area in order to allow the user to have a wide contact force area for displacement of system 10. The broad surface area is of importance in that such does protect screen or storm door 12 from impact and allows initial force loading to be applied to system 10 without the necessity of the user impacting or otherwise touching door 12.

Planar member 30 is generally mounted approximately one-half the vertical distance of the extension of door 12. With a broad surface area to be contacted by the user, such allows operators of varying heights to easily accomplish the opening procedure.

As can be seen from FIGS. 1 and 3, planar member 30 is generally U-shaped in contour and includes slot 36 formed therethrough. Slot 36 passes in transverse direction 22 and generally extends from first end 38 in an open contour fashion as is more specifically seen in FIG. 3. In this manner, there is formed first leg 40 and second leg 42 extending in transverse direction 22. Legs 40 and 42 in combination with slot 36 provide a tolerance opening within which automatic closing device 16 may be inserted without contacting or otherwise disrupting attachment of planar member 30 to door 12.

Planar member 30 may be formed of a wood composition. Additionally, indicia or other designs may be incorporated on inner surface 34 to provide a pleasing design. In the alternative, planar member 30 may be formed of a plastic material of differing colors having indicia formed thereon or may be provided in a transparent material such that the inner surface of storm or screen door 12 may be visible therethrough. Additionally, planar member 30 may be formed of a metal composition such as aluminum or some like material.

As can be seen from FIGS. 1, 2 and 3, hinge members 46 are secured to an inner surface at door 12 and to an outer surface 44 of planar member 30. In general, hinge members 46 are L-shaped in contour and secured to planar member 30 through screws, bolts or other like fastening mechanisms 48. Hinge members 46 are rotationally displaceable about axis line 50 extending in vertical direction 32. In this manner, it is seen that planar member 30 is rotationally displaceable about a vertically directed axis line. Each of hinge members 46 are mounted respectively to first leg 40 and second leg 42 of planar member 30 near or on first end 38. In installation, it must be remembered that hinge members 48 are to be vertically alignable each with respect to the other in order that the entire planar member 30 be rotational in a horizontal plane about axis pivot lines 50 of each of hinge members 46.

Door system 10 further includes actuating means 52 for interfacing with latch lever 28 to displace such. Actuating mechanism 52 is fixedly secured to planar member 30 and releasably captures latch lever 28. Latch lever 28 is positionally located to permit contact relation with actuating mechanism 52. Actuating mechanism or latch receiving frame member 52 includes opening 54 within which latch lever 28 is received in transverse direction 22. As can be seen, latch receiving frame member 52 includes opposingly displaced side walls 56 and 58 which act as guideways for insert of latch lever 28. Frame member 52 includes base element 60 having bolts, screws or other fastening systems 62 passing through outer surface 44 of planar member 30 in order to positionally locate in secured fashion actuating mechanism 52 to planar member 30.

Door opening system further includes recess section 64 extending in vertical direction 32 formed within second end 66 of planar member 30. Recess 64 is formed for the purpose of providing an opening within which a door knob may be inserted without interfering with planar member 30. Thus, when door 14 is placed in a closed position, a door knob associated therewith will not contact planar member 30 to inadvertently open outer or screen door 12.

In general practice, latch lever 28 is located vertically above or below the door knob of inner door 14. The vertical displacement of door latch lever 28 and the inner door knob is of consequence such being to avoid interference between latch lever 28 and the door knob when doors 14 and 12 are in a mutually closed position. Cut out or recess section 64 provides sufficient clearance for inner door knob to pass therethrough without contacting planar member 30.

Although this invention has been described in connection with specific forms and embodiments thereof, it will be appreciated that various modifications other than those discussed above may be resorted to without departing from the spirit or the scope of the invention. For example, equivalent elemental structures may be substituted for those specifically shown and described, certain features may be used independently of other features, and in some cases, elements may be reversed, all without departing from the spirit or the scope of the invention as defined in the appended claims.

What is claimed is:

1. A door opening system for releasably actuating a door latch having a displaceable latch lever and latch handle and rotatably displacing a door in one motion of a user, said door extending in a vertical and transverse direction in a substantially planar contour including an automatic closing device coupled to a jamb of said door and extending in said transverse direction for securement to an inner surface of said door, comprising:

(a) a planar member extending in a transverse direction across said door adjacent and substantially parallel to a plane of said door, said planar member having a vertical extension substantially greater than a vertical extension of said door latch for providing a large planar contact surface between said planar member and a portion of the body of a user; said planar member having a predetermined contour for providing non-interference of said planar member with said automatic closing device; and, (b) means for actuating said door latch for displacing said latch lever, said actuating means being fixedly secured to said planar member and said latch lever being positionally located in contact relation therewith.

2. The door opening system as recited in claim 1 where said planar member is U-shaped in contour, having a slot formed therethrough passing in said transverse direction from a first end of said planar member, said slot extending coincidental said automatic closing device for providing clearance and access to said automatic closing device.

3. The door opening system as recited in claim 2 including hinge means secured to said door and said planar member at said first end of said planar member.

4. The door opening system as recited in claim 3 where said hinge means includes a pair of hinge members vertically displaced each from the other in a non-contiguous manner, said hinge members being mounted respectively to a first and second transversely extended leg member of said U-shaped planar member substantially at said first end of said planar member.

5. The door opening system as recited in claim 4 where said actuating means includes a latch receiving frame member having an opening for receiving said latch handle, said frame member being fixedly secured to said planar member.

6. The door opening system as recited in claim 5 where said latch receiving means displaces said latch lever responsive to a force displacement applied to said planar member.

7. The door opening system as recited in claim 2 where said planar member includes a vertically directed recess formed within a second end of said planar member for providing clearance between a door knob mounted on an inner door and said planar member.

8. The door opening system as recited in claim 7 where said planar member is formed of a wood material.

9. The door opening system as recited in claim 7 where said planar member is formed of a metal composition.

10. The door opening system as recited in claim 7 where said planar member is formed of a plastic material composition.

11. The door opening system as recited in claim 10 where said planar member is substantially transparent.

* * * * *